US008960736B2

(12) United States Patent
Graute

(10) Patent No.: US 8,960,736 B2
(45) Date of Patent: Feb. 24, 2015

(54) MOTOR VEHICLE DOOR LOCK

(75) Inventor: Ludger Graute, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 452 days.

(21) Appl. No.: 12/918,270

(22) PCT Filed: Feb. 21, 2009

(86) PCT No.: PCT/DE2009/000257

§ 371 (c)(1),
(2), (4) Date: Sep. 29, 2010

(87) PCT Pub. No.: WO2009/106054

PCT Pub. Date: Sep. 3, 2009

(65) Prior Publication Data

US 2011/0012375 A1 Jan. 20, 2011

(30) Foreign Application Priority Data

Feb. 28, 2008 (DE) ..... 10 2008 011 545

(51) Int. Cl.

| | |
|---|---|
| ***E05B 3/06*** | (2006.01) |
| ***E05B 81/06*** | (2014.01) |
| ***E05B 81/16*** | (2014.01) |
| *E05B 15/04* | (2006.01) |

(52) U.S. Cl.

CPC ..... *E05B 81/06* (2013.01); *E05B 81/16* (2013.01); *E05B 2015/0493* (2013.01); *Y10S 292/61* (2013.01)

USPC ..... 292/200; 292/DIG. 61; 292/219

(58) Field of Classification Search

USPC ..... 292/200, 219–229, DIG. 61X

See application file for complete search history.

(56) References Cited

U.S. PATENT DOCUMENTS

| | | | | |
|---|---|---|---|---|
| 6,382,687 | B1 * | 5/2002 | Gruhn | 292/201 |
| 6,715,806 | B2 * | 4/2004 | Arlt et al. | 292/201 |
| 7,261,339 | B2 * | 8/2007 | Kiehl | 292/216 |
| 7,568,740 | B2 * | 8/2009 | Brose et al. | 292/216 |
| 7,568,741 | B2 * | 8/2009 | Odahara | 292/216 |
| 7,905,523 | B2 * | 3/2011 | Stefanic et al. | 292/201 |
| 2003/0074935 | A1 | 4/2003 | Baukholt | |
| 2005/0167990 | A1 * | 8/2005 | Orzech et al. | 292/201 |

FOREIGN PATENT DOCUMENTS

| | | | |
|---|---|---|---|
| DE | 32 20 705 | A1 | 12/1983 |
| DE | 40 28 992 | A1 | 9/1991 |
| DE | 40 42 678 | C1 | 10/1999 |
| DE | 102 47 842 | A1 | 3/2004 |
| GB | 2 292 772 | A | 3/1996 |
| JP | 2008088708 | A * | 4/2008 |

* cited by examiner

*Primary Examiner* — Mark Williams
(74) *Attorney, Agent, or Firm* — Konomi Takeshita

(57) ABSTRACT

A motor vehicle door lock comprising at least one lever (1), particularly a securing lever and a spring (2) that is associated with the lever (1), wherein the spring (2) interacts with an associated contour (4) in order to form a bistable position securing unit (2, 4).

6 Claims, 2 Drawing Sheets

MOTOR VEHICLE DOOR LOCK

CROSS REFERENCE TO RELATED APPLICATIONS

This application claims priority under 35 U.S.C. 119 and 35 U.S.C. 365 based upon German Patent Application No. 10 2008 011 545.2, filed on Feb. 15, 2008. The entire disclosure of the aforesaid application is incorporated herein by reference.

FIELD OF THE INVENTION

The invention relates to a motor vehicle door lock with at least one lever, particularly a securing lever and a spring associated with the lever.

BACKGROUND OF THE INVENTION

The lever or the securing lever is generally a locking lever, a double lock lever, a child-safety lever or similar. Such levers are in fact in most cases characterized by taking up (having to take up) at least two (stable) end positions or generally at least two reproducible positions. In case of a locking lever, these are the "unlocked" and "locked" positions. A double lock lever must feature the positions "double lock on" and "double lock off". The child-safety lever finally corresponds to the positions "child-safety on" and "child-safety off".

The type-defining prior art according to DE 32 20 705 C2 contains an intermediate lever assigned to a release lever for a locking mechanism with the release lever being continuously acted upon by the resetting force of a spring.

In DE 40 42 678 C1 a memory lever is assigned to the release lever, with a spring pushing said memory lever against the release lever when the vehicle door is closed. The spring is a leg spring.

The prior art is not convincing in all aspects. The known leg springs, for instance, ensure that the associated lever is acted upon but cannot prevent that also an unwanted axial force is introduced and/or the moments can only be inadequately adjusted in the end positions, making these solutions susceptible to tolerances. The invention aims to remedy this.

SUMMARY OF THE INVENTION

The invention is based on the technical problem of further developing such a motor vehicle door lock so that the functional positions described above can be easily maintained and shown.

In order to solve this technical problem, the invention provides in a type-defining motor vehicle door lock that the spring interacts with an associated contour to jointly form a bistable position securing unit.

The invention thus uses a special position securing unit, consisting of the spring and an associated contour. The spring can be arranged in a lock casing or in a lock housing or can be supported. The contour is in most cases arranged on the associated lever. The opposite is, however, also possible with the contour being provided on the lock casing or lock housing with the lever containing the spring. The position securing unit is, in any case bistable, i.e. able to represent at least two positions of the lever. In other words, the position securing unit ensures that the lever retains both positions once they have been assumed. The lever only leaves the positions again if a special force is exerted on the lever.

If the lever is a locking lever, the two positions correspond with the positions "unlocked" and "locked". In case of a double lock lever, the two stable positions belong to the positions "double lock on" and "double lock off". The same applies to the child-safety lever, assuming the functional positions "child safety on" and "child safety off".

In general it has proven to be advantageous for the spring to be designed as a leg spring with two spring legs. Such a leg spring does actually in most cases not only contain the two spring legs but also at least one spring coil with the aid of which the leg spring is either arranged at the lock casing or lock housing or on or at the lever and is supported by these. Most embodiments contain a pin extending through the spring coil for securing the leg spring.

The lock can be designed in such a way that the two spring legs of the leg spring jointly interact with the contour. It is, however, also possible that one of the spring legs interacts with the contour and the other spring leg with another lever to, for instance, resiliently act upon said lever.

It has proven to be advantageous if the contour contains at least one shape, pretensioning the spring resting against it. Apart from this in most cases convexly arched shape, the contour has one or more adjacent abutting surfaces applying, in contrast, less initial tension on the spring. In most cases, two spaced-apart shapes or convex bulges are provided on the contour, between which an abutting surface is located. In such embodiments each of the two spaced-apart shapes are reserved for one of the spring legs of the leg spring.

The two spring legs rest actually in most cases, when in both bistable end positions of the lever, fully against their associated shape. In other words, the spring legs and the associated shape form an interacting pair.

In general, the lever is arranged to rotate at least around one axis. The contour is, on the other hand, arranged on the lever. In this way, using the contour in connection with the spring or the position securing unit of the invention, a force can be exerted on the lever, said force corresponding to a rotational moment, producing in most cases either a clockwise or counterclockwise rotation of the lever around the axis.

In this context it is regularly provided that the spring is arranged in a fixed position opposite the contour, moving together with the lever. In general it is, however, also possible—as already described—and in the sense of a kinematic reversal, for the contour to be arranged in a fixed position with the spring and the lever, on the other hand, moving. In any case the spring together with the contour or the bistable position securing unit of the invention produces, on the whole, a resulting force component, acting upon the lever in counterclockwise direction in one end position and in clockwise direction in the other end position. To ensure that these end positions are reliably attained and retained, the lever is in most cases connected to a drive element. The drive element ensures that the movements of the lever in clockwise or counter-clockwise direction are predefined and/or limited.

Consequently a motor vehicle door lock is provided that is equipped with a special bistable position securing unit. This bistable position securing unit ensures that lever provided with such a unit is able to occupy at least two end positions in a stable manner. These end positions could, for instance, belong to the positions "lock engaged" and "lock disengaged", provided the lever is a locking lever.

In most cases the additional connection of the lever to the drive element ensures that, on one hand, the lever takes up at all the two described end positions and, on the other hand, also retains these.

All in all this provides an easy to install, cost-effective bistable position securing unit. The bistable position securing unit generally ensures that a respective end position or also intermediate position is reliably and permanently assumed and thus defined. Any tolerances when taking up the end position can be compensated for without problem.

Depending on the design of the contour or of one or both shapes or of one or several abutting surfaces, the pre-tensioning acting as it were on the lever or the forces exerted by the spring legs, can be individually adjusted. The forces exerted can indeed be almost set independently for each spring leg by adapting the geometry of the contour and thus the interaction pairs. The respective resulting force thus acts upon the lever in the two end positions causing, on one hand, a rotational moment in counter-clockwise direction and, on the other hand, a rotational moment in clockwise direction and ensuring, where applicable, in connection with the drive element limiting the rotational movement, that the end position is reliably attained. These are the main advantages of the invention.

BRIEF DESCRIPTION OF THE DRAWINGS

Below, the invention is described in more detail with reference to exemplary drawings showing only one embodiment, as follows.

Figure 1:
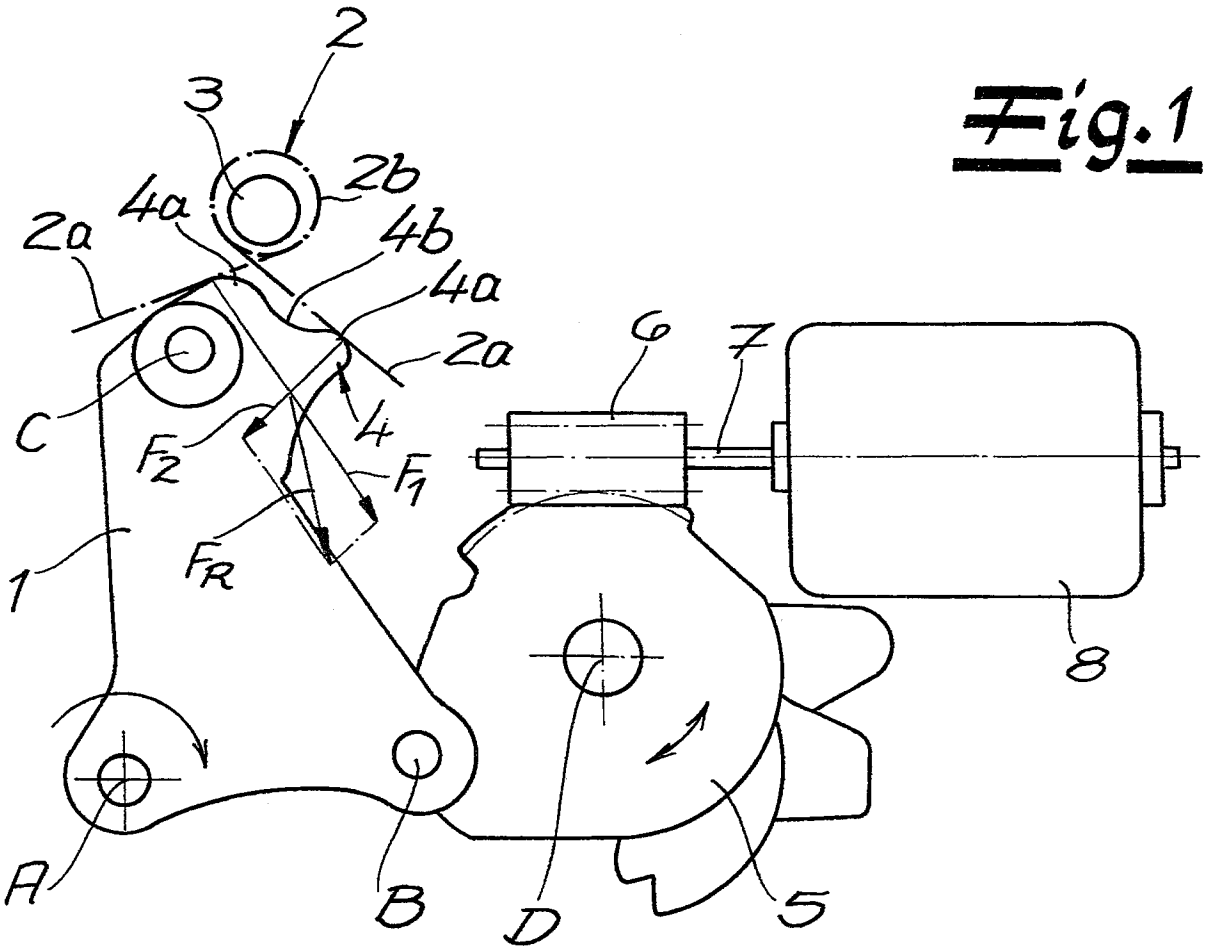
FIG. 1 shows a motor vehicle door lock according to the invention with a locking lever in the "unlocked" position.

Other features and advantages of the present invention will become apparent from the following detailed description, taken in conjunction with the accompanying drawings which illustrate, by way of example, the principles of the invention.

DETAILED DESCRIPTION OF THE INVENTION

The figures show a motor vehicle door lock, reduced to the elements essential for the invention. The figures actually show a lever 1, in this case designed as a general securing lever and representing a locking lever 1 in the example. A spring 2 is assigned to the lever 1. Although the invention is not limited to this design, the spring 2 in the embodiment is a leg spring, consisting of two spring legs 2*a* and a coil 2*b* connecting the two spring legs 2*a*.

A pin 3 extends through the spring coil 2*b* and provides the support and seat of the spring or leg spring 2. To achieve this, the said pin 3 is arranged on a lock casing or a lock housing in the example although the invention is not limited to this design.

The spring 2 is assigned to a contour 4, which in this case is connected to lever 1. Together, spring 2 and contour 4 form a bistable position securing unit 2, 4. In the example, the two spring legs 2*a* also interact with the respective contour 4 for this purpose. It is, however, also possible that only one spring leg 2*a* interacts with the contour 4 and the other spring leg 2*a* with another lever. This alternative has, however, not been shown.

It is apparent that the contour 4 consists of two spaced-apart and convexly bulging shapes 4*a* and an abutting surface 4*b* arranged between the two shapes 4*a*. As part of this arrangement the respective contour 4*a* and the spring leg 2*a* of the leg spring 2 abutting against said contour generally continuously interact and form an interaction pair 2*a*, 4*a*. In other words, the spring leg 2*a* fully abuts in both bistable end positions of lever 1—described in detail below—against the associated shape 4*a*. This is directly apparent when comparing FIGS. 1 and 2.

In the embodiment, lever 1 is mainly a triangular lever 1, although the invention is naturally not limited to this design. The lever 1 is arranged to be rotatable around an axis A opposite the said lock casing or lock housing. For this purpose, a pin arranged in the lock casing or lock housing can extend at this point through the provided opening.

The aforementioned contour 4 is located at the end of the lever 1 furthest away from the axis. Together with a pivot joint B the axis A forms a base for the all in all triangular lever 1, at whose tip, contour 4 is provided and a connection point C is located, which can for instance be connected to a coupling lever (not shown). By adjusting the lever 1, the coupling lever can be engaged and disengaged and thus allows, in the engaged position, the locking mechanism to be opened by an internal operating lever or an external operating lever and interrupts, in its disengaged position, the described functional chain, so that any force or pulling movements applied on the internal operating lever have no effect. During this process, the first position corresponds with the "unlocked" position of the lever or locking lever 1, with the latter position reflecting its functional "locked" position.

All in all, the spring or leg spring 2 is arranged in a fixed position opposite the contour 4. As each of the two spring legs 2*a* acts upon the associated shape 4*a* with a force $F_1$ or $F_2$, this produces an overall force $F_R$, whose direction differs depending on the position of lever 1. In the position "unlocked" in FIG. 1, the forces $F_1$ and $F_2$ generated by the spring legs 2*a* are added together in such a way that the resulting force $F_R$ produces a rotational moment in relation to axis A of lever 1, corresponding to a clockwise rotation around axis A, as indicated by the arrow in FIG. 1. As a result, the lever 1 is turned clockwise or is acted upon accordingly in the end position of a drive element connected to lever 1 via a pivot joint B.

The drive element 5 is actually a worm gear 5, which can be turned around an axis D in clockwise or counter-clockwise direction with the aid of an endless screw 6. This is achieved by the drive element or worm gear 5 being acted upon accordingly by the endless screw 6, located on a drive shaft 7 of a drive motor 8.

To now move the lever 1 into its "unlocked" position, the drive element 5 is mechanically acted upon via the internal locking or external locking or alternatively with the aid of the drive motor 8 connected via the endless worm 6 in such a way that the drive element or worm gear 5 turns counterclockwise up to its end position, carrying along the lever 1 until the position shown in FIG. 1 has been reached. In order to permanently maintain this position in the sense of an end position securing mechanism, the spring or leg spring 2 and the contour 4 ensure, as a combined bistable position securing unit 2, 4, that the lever 1 is acted upon by a rotational movement corresponding to a clockwise rotation in relation to its axis A.

Figure 2:
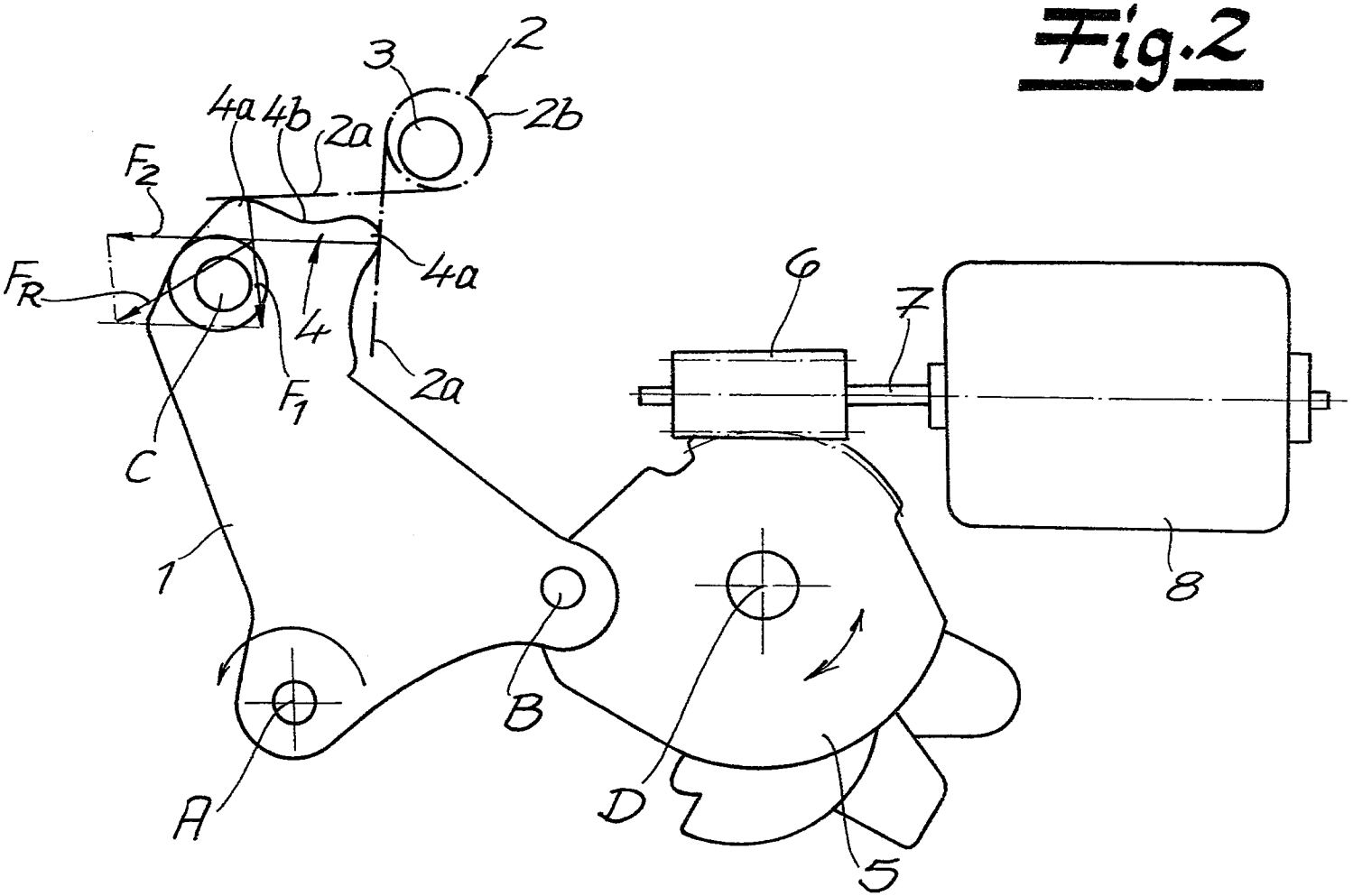
FIG. 2 shows the object of FIG. 1 in the "locked" position.

In order to change the lever 1 to its "locked" position as shown in FIG. 2, the drive element or worm gear 5 is acted upon in clockwise direction with the aid of the drive motor 8, so that the lever 1, starting from the position shown in FIG. 1 turns counter-clockwise around axis A until the second end position shown in FIG. 1 has been reached. To achieve this, the said rotational moment must be overcome.

In this case (FIG. 2) the two spring legs 2*a* in turn act upon the two associated shapes 4*a* of contour 4 in such a way that the forces $F_1$ and $F_2$ are added together. After the rotation of the lever 1, the respective power vectors have, however, changed their direction so that the resulting force $F_R$ now generates a rotational moment around axis A, corresponding to a counter-clockwise rotation of lever 1. This means that the bistable position securing unit 2, 4 according to the invention generates in each case a resulting force $F_R$, which produces a rotational moment in the respective end position in such a way that it acts in the same direction as the previous operation of the drive motor 8 or the previous motive force on the drive element 5.

As a result, the respective end position is reliably attained and maintained and the lever 1 can, for instance, not leave the "unlocked" or "locked" position in the example by itself or because of malfunctioning. To achieve this, a rotational moment would have to be applied to it that overcomes the moment of the position securing unit 2, 4 and, where applicable, also the static friction forces produced by the drive motor 8 including the endless screw 6 and the drive element 5. This ensures reliability, whilst at the same time simplifying the design and installation. Also the tolerances for the design of the spring 2 and the contour 4 can be easily managed.

It is to be understood that the above-described embodiment is illustrative of one of the many possible specific embodiments which can represent applications of the principles of the invention. Numerous and varied other arrangements can be readily devised by those skilled in the art without departing from the spirit and scope of the invention.

What is claimed is:

1. A motor vehicle door lock comprising: at least one lever (1) arranged so that it can be rotated at least around one axis (A), and a spring (2) that is associated with the lever (1), and a contour (4) that is formed on the lever (1) and is associated with the spring (2), said at least one lever including a securing lever, the spring (2) being a leg spring (2) with two spring legs (2*a*), and said contour (4) having two protruding shapes (4*a*) connected by a concaved section (4*b*), wherein the spring legs (2*a*) of the spring (2) interacts with the two protruding shapes continuously via rotations of the lever (1) around the axis (A), resulting in either one or an other of bistable end positions, thereby forming a bistable position securing unit (2, 4).

2. The motor vehicle door lock according to claim 1, wherein the spring (2) is arranged in a lock casing or lock housing and the contour (4) is arranged on the lever.

3. The motor vehicle door lock according to claim 1, wherein the two protruding shapes of the contour (4) abut and prestress the two spring legs of the spring (2) respectively.

4. The motor vehicle door lock according to claim 3, wherein each of the spring legs (2*a*) in both bistable end positions of the lever 1 is resting fully against the respective shape (4*a*) associated therewith, forming a pair (2*a*; 4*a*) that interact with each other.

5. The motor vehicle door lock according to claim 1, wherein the spring (2) is arranged in a fixed position facing the contour (4), and together with the contour (4) the spring (2) generates a resulting force component ($F_R$) which acts upon the lever (1) in counter-clockwise direction in one end position and in clockwise direction in its other end position in relation to the rotational axis (A) of the lever (1).

6. The motor vehicle door lock according to claim 1, wherein the lever (1) is connected to a drive element (5) which determines and limits the lever's movements in clockwise and counter-clockwise direction around the rotational axis (A).

* * * * *